US007089996B2

(12) United States Patent
Stroobants et al.

(10) Patent No.: US 7,089,996 B2
(45) Date of Patent: Aug. 15, 2006

(54) DECORATIVE RADIATOR

(76) Inventors: Marcel Stroobants, 1/A1 Klaplaar, B2500 Lier (BE); Pierre Vercauteren, 4 B 18 Goudenregenlaan, B2610 Wilrijk (BE)

( * ) Notice: Subject to any disclaimer, the term of this patent is extended or adjusted under 35 U.S.C. 154(b) by 356 days.

(21) Appl. No.: 10/450,297

(22) PCT Filed: Dec. 14, 2001

(86) PCT No.: PCT/BE01/00213

§ 371 (c)(1),
(2), (4) Date: Jun. 13, 2003

(87) PCT Pub. No.: WO02/48629

PCT Pub. Date: Jun. 20, 2002

(65) Prior Publication Data

US 2004/0182557 A1 Sep. 23, 2004

(30) Foreign Application Priority Data

Dec. 15, 2000 (BE) ..... 2000/0791

(51) Int. Cl.
*F28F 3/12* (2006.01)
*F24D 19/02* (2006.01)
*F24H 9/02* (2006.01)

(52) U.S. Cl. ..... 165/49; 165/53; 165/57; 165/168

(58) Field of Classification Search ..... 165/47–49, 165/53, 56–57, 168, 169, 170, 903–905
See application file for complete search history.

(56) References Cited

U.S. PATENT DOCUMENTS

| | | | | | |
|---|---|---|---|---|---|
| 2,205,001 | A | * | 6/1940 | Timmis et al. | 237/1 R |
| 3,162,243 | A | * | 12/1964 | Dziekonski | 165/55 |
| 3,582,614 | A | * | 6/1971 | Zellers | 392/436 |
| 4,121,653 | A | * | 10/1978 | Vinz | 165/49 |
| 4,168,740 | A | * | 9/1979 | Cairenius | 165/49 |
| 5,632,327 | A | * | 5/1997 | Andersson | 165/49 |
| 5,896,914 | A | * | 4/1999 | Fieback et al. | 165/10 |

FOREIGN PATENT DOCUMENTS

| | | |
|---|---|---|
| DE | 2009547 | 9/1971 |
| DE | 2364598 A1 | 6/1975 |
| DE | 2727219 A1 | 1/1979 |
| EP | 0386497 A2 | 9/1990 |
| EP | 0813036 A2 | 12/1997 |

* cited by examiner

*Primary Examiner*—Tho Duong
(74) *Attorney, Agent, or Firm*—Akerman Senterfitt; Jerold I. Schneider

(57) ABSTRACT

A radiator is disclosed for mounting in an upright position to a wall, comprising a front panel and a back panel between which an interior space is provided for introducing a fluid. The back panel is made of a heat-conductive material and is provided with fluid supply and drainage fittings for supplying and draining the fluid to and from said interior space. The back panel is further provided with cooling ribs for exchanging heat with surrounding air and mounting brackets for mounting the radiator on a wall. The front panel has pre-formed canals for directing the fluid flow in a controlled way from the supply fitting to the drainage fitting. The front panel is made of a synthetic material which is substantially non-heat-conductive. A seal is provided between the panels for making said interior space substantially fluid-tight. The front and back panels are assembled with the seal in between by means of bolts.

15 Claims, 5 Drawing Sheets

DECORATIVE RADIATOR

CROSS-REFERENCE TO RELATED APPLICATIONS

This applications claims the priority of International Application No. PCT/BE01/00213, filed Dec. 14, 2001, which claims the priority of Belgium Patent No. 2000/0791, filed Dec. 15, 2000, both of which are incorporated herein by reference in their entireties.

BACKGROUND OF THE INVENTION

The market of radiators, based on the input of warm water, in domestic use, is divided in 2 main groups:

a) radiators made of steel plate and mostly manufactured in a mass production;

b) so called "design radiators", made basically of different kinds of tubes, whose forms and measures are targeted to the clients' wish.

To produce them, the radiators as described in a) need main investments, starting from a plate of steel, cut in the desired forms, in which "canals" are being pressed, whereupon the radiator is formed by a specific welding process, to make them waterproof.

In most cases, several radiators are connected as a whole unit at which thermal panels are attached between those connected radiators, to become a more efficient thermal emission.

In a final phase, several pieces of water supply and drainage are attached to this unit by welding techniques.

Last but not least, the radiator is tested on waterproof, after which it's painted (degrease, primer, coating).

Such a complex production line needs high-costs investments.

A production lines just for one type of radiator, has been estimated for an investment of 800 million BEF.

The investment of a paint installation, used for several production lines (nowadays seven !) is estimated up to 200 million BEF.

As the producing techniques are well known and different patents are expired, the last few years there is a huge import of "plated forms", produced in low-cost countries.

The involved sectors are refining their production techniques to re-establish their market position. But still the technique of reforming a steel plate and welding it, is their basic element.

The so called design radiators, as specified under b), are showing a boom to other sectors such as kitchens, showrooms, offices and villa's, after their introduction for the use in bathrooms (i.e. to warm towels).

In spite off the habit of producing them in "standard measures", to produce them in a large serial to become a lower cost and so a lower price, a main share and target are the custom-made goods.

Naturally the cost of a personalized radiator is perceptively higher, compared to the standardized model.

Many welding techniques are developed to connect the steel tubes in their different kinds of forms to become a desired look.

In most cases, special colours are chosen to become a harmony with their spaces in which they will be used.

By both groups of radiators, the supply of warm water is connected to their highest point, from which it can search its way undefined through a web of canals to a main drainage tube.

Its unnatural way of free direction means several "cold zones" to the radiator and a constantly and equally changing of pressure in the radiator.

Meanwhile the produce of heat, which begins at the top of the radiator, has no optimal effect: the water becomes colder in its way down, which doesn't stimulate the circulation of air and the heat.

BRIEF SUMMARY OF THE INVENTION

It is an aim of the Invention to avoid those disadvantages by realising a controlled flow of hot water, which is achieved by a developed system of canals.

The decorative radiator of the invention is composed of two panels: a front panel made of a synthetic material and a back panel made of a heat-conductive material. The front panel has pre-formed canals for obtaining a controlled flow of hot water in the radiator. The back panel is provided with fluid supply and drainage fittings, via which a heating fluid such as for example water can be supplied and drained. Between both panels a seal is placed for making the radiator watertight. The panels are assembled by means of assembling means such as for example bolts. The back panel is further provided with heat exchanging means such as for example cooling ribs for improving the heat exchange with the surrounding air and with mounting means such as for example brackets for mounting the radiator to a wall.

The front panel is preferably constructed of a non-heat-conductive synthetic material, such as for example polyamide. The front panel may be coloured during its production, while different colours may be used for this colouring. The front panel may furthermore be provided with a relief pattern on the visible side, which may have different shapes. The front panel may for example be made in a mould by an injection technique.

The front panel preferably comprises slots on top, through which the hot air may be evacuated from the back panel. On the sides, the front panel may comprise hollow spaces, which form cavities with the back panel for use as water containers. Due to the heating, these water containers will function as air humidifiers. The openings on top of these humidifiers, which are provided for dispensing water vapour may be located in a detachable cap, so that the humidifier can be refilled and cleaned.

The heat-conductive material of the back panel may for example be aluminium or a composite material. The flat part of the back panel contacts the water flowing through the canals and water which is located in the cavities used as humidifier. The back panel further comprises supply and drainage fittings, via which the hot water can be supplied and drained.

The back panel can for example be made by injection without post-treatment, by extrusion with post-treatment or by rolling with post-treatment. The post-treatment is done for selectively removing some of the cooling ribs, if desired.

The entry of hot water into the preformed canals of the front panel is preferably located as high as possible. This has the advantage that a thermal supply tap which is connected on the supply fitting can be controlled more comfortably. The preformed canals are preferably provided for causing a warming-up effect in ascending direction, which can make the heating more efficient. Furthermore, the preformed canals are preferably provided for guiding the cooled water through the parts of the radiator which are "touchable", so that the danger of bums can be limited.

BRIEF DESCRIPTION OF THE DRAWINGS

These drawings are based on the construction of a horizontal right-angled embodiment of the radiator of the invention, of approximately 100 cm by 50 cm (height×width).

The following scales are being used in the following drawings.

DETAILED DESCRIPTION OF THE INVENTION

The use of the coloured synthetic granules by the fabrication of "the body" of the radiator (see FIG. 1—part 1) allows us to make a large range of different colours. We remark that the synthetic materials will be effectively coloured, which will not reveal a slight damage.

It is clear that the fact of No PAINTING will lead to a considerable cost saving and a less cause of environmental damage. (no painting installation is needed).

The total weight of the radiator will be considerably less than a "classic radiator" of the the same measurements, a fact which the installers will not regret.

The decorative radiator can be realised in all kinds of colours, forms and shapes. The front side (visible side) of the front panel can be flat, on which every design, modern or classical, black and white or in one or different colours, using several print techniques.

The front side can be fabricated with a bas-relief, expressing a classic or modern theme and, if it's the case, after the formation of the design in the mould, entirely or partly can be re-coloured by the use of several techniques.

All materials, used for this assumed radiator, will be recycled for 100%, which means, from the point of view of environmental damaging, an advantage that is not to be sneezed at.

The assumed radiator is totally re-designed as the following facts:

due to the huge problems which have to do with the processing of steel or welding we searched for the use of other materials, with the goal to reduce the use of welding techniques and, if so, ignoring these techniques.

Figure 1:
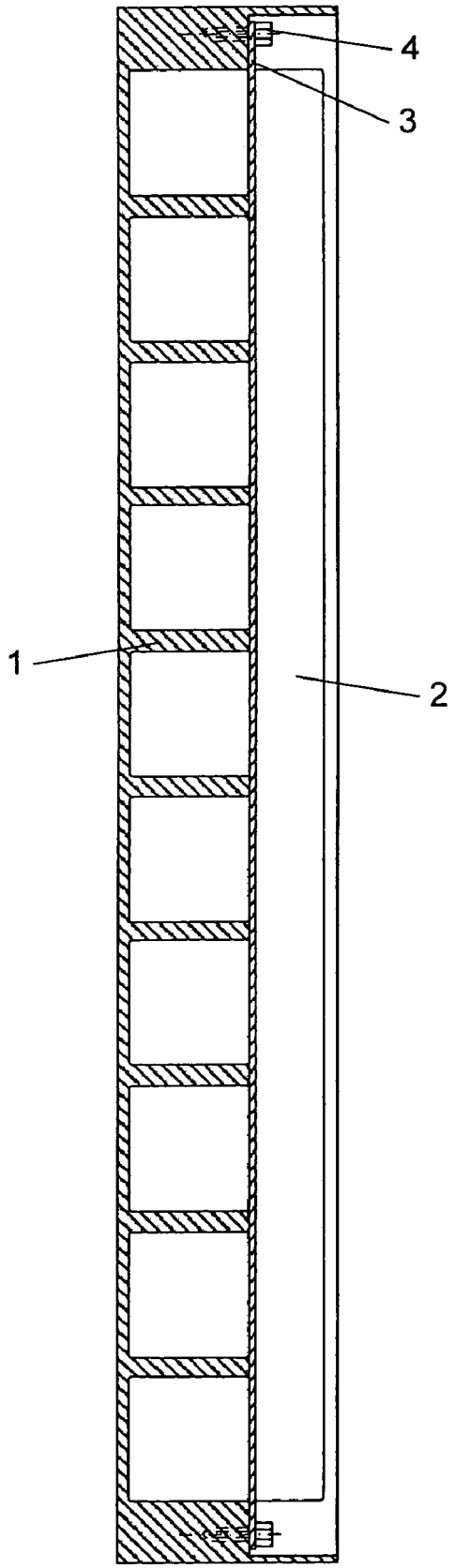
FIG. 1 (scale ½) shows the body of the embodiment of the radiator of the invention.
Figure 2:
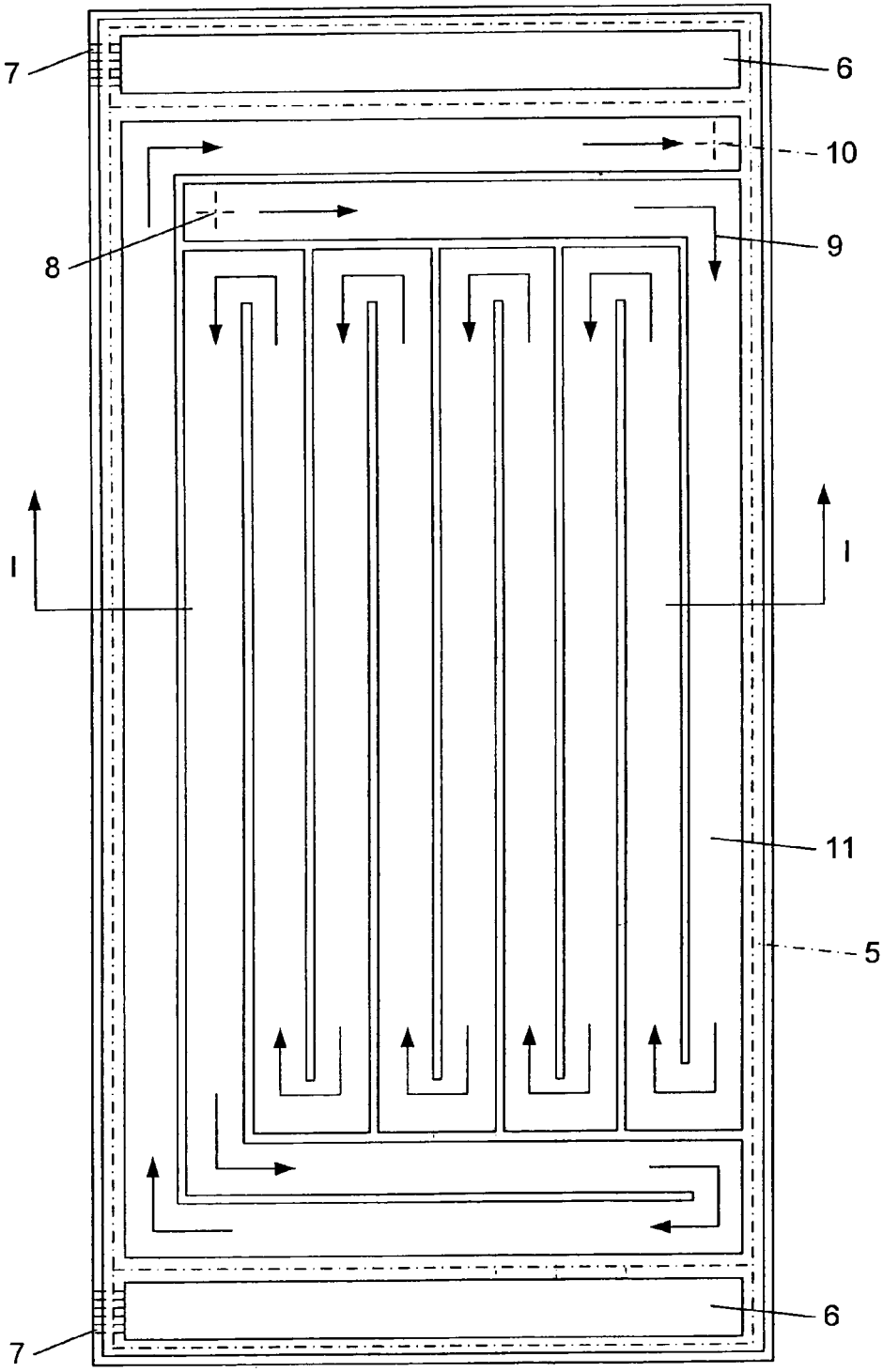
FIG. 2 (scale ¼) shows the back side of the synthetic front panel of the embodiment of the radiator of the invention.

As FIG. 1 (cross-section of the radiator according the direction I—I in FIG. 2) shows, the assumed radiator consists in:

a) a synthetic panel 1, with several canals on the inside and a flat part on the upper side the front side, the sides and partly along the under side;

b) a panel 2 of aluminium (or a heat-conductive composite material) from which the flat side makes contact with the hot water, causing a heating effect and evacuate the hot air by making contact with the cooling ribs to the atmosphere and by "the flat part" on the left and on the right transposed to the humidifier;

c) a sealing ring 3 in stainless steel, an aluminium synthetic or rubber, to create a waterproof radiator)

d) screws 4 for attachment, to connect the aluminium panel along the back side of the front panel 1 with this panel.

FIG. 2 shows the back side of the synthetic front panel. Axis 5 marks the position of the sealing ring. The cavities 6, left and right, distribute through the openings 7 the vapour into the atmosphere.

The water is heated via the flat part of the heat-conductive back panel.

The openings 7 have a removable "cap" and they are used to fill or clean the cavities 6. Mark 8 points to the place through which, via the connector in the back panel, the warm water is supplied. This position was chosen high to simplify the control of the radiator and to realise an acceptable place for the measuring of the outside temperature. We expect the utilization of a thermal tap. According to the laws of nature like of the communicating barrels, this will have a positive effect on the equal filling-up of the radiator.

The arrows 9 points out the "controlled way" that the warm water has to follow. At last, the cooled water will leave the radiator via the attachment in the back panel on position 10 to the drainage pipe. Following the arrow 9 first, the warm water will be guided to the bottom, so the radiator exchanges its warmth at the bottom of the back panel and the rising warm air helps to warm the back panel; as a result the warmth supply of the back panel can be realised in a quicker way.

The system of canals 11 guides the chilled water through the outside and the upper side to the drainage. Together with the fact that the synthetic front panel is NOT HEAT-CONDUCTIVE, this radiator reduces the danger of burns for humans as well as for pets.

Figure 3:
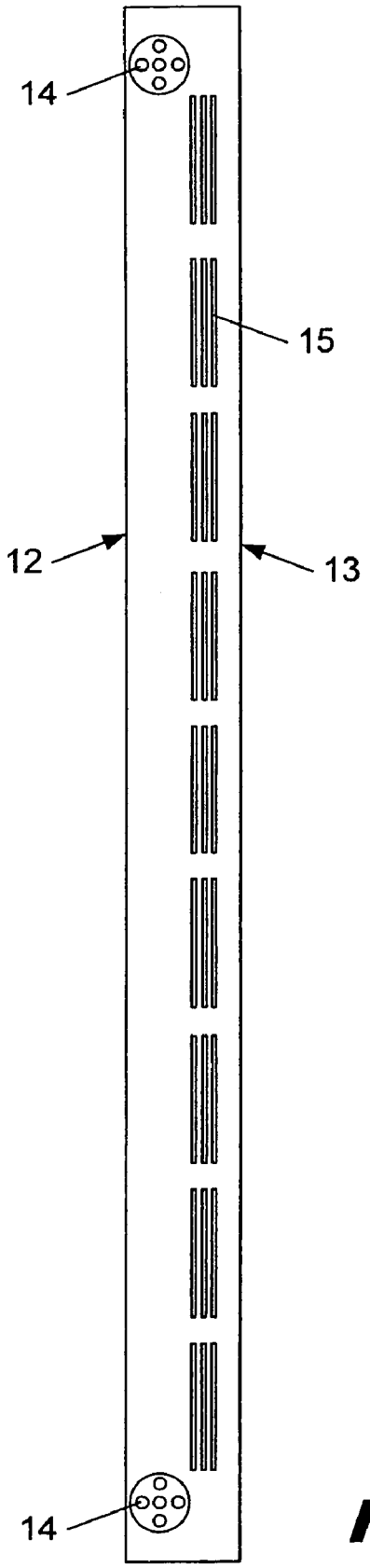
FIG. 3 (scale ¼) shows a top view of the embodiment of the radiator of the invention.

FIG. 3 shows a top view of the radiator. Side 12 reveals the front side. This front side can be flat or have "a pattern of relief", as the client wishes. The front side contains a sign of the manufacturer. The mould can be made in a way that the piece of the sign can be replaced by another sign from for example a special customer, a dealer, an architect, etc.

Side 13 is directed to the wall on which the radiator will be placed. Point 14 shows the position of the opening of refilling of the humidifier. Point 15 shows the position of the cut-away on top of the back panel, through which the warm air will be evacuated. At the bottom of the radiator and at the position of the back panel, there is no material of the front panel. This cut-away allows to realise a circulation of air.

Figure 4:
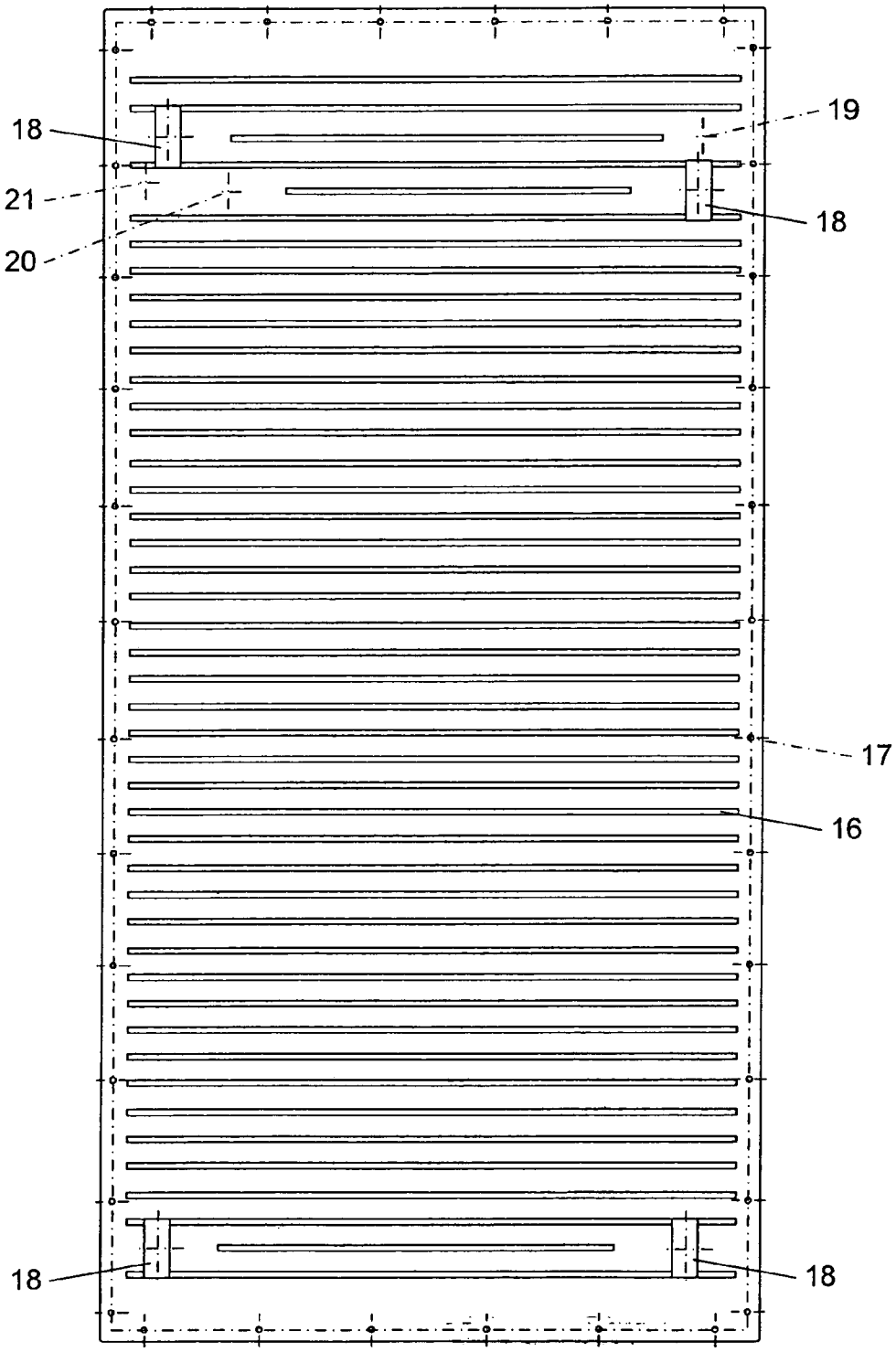
FIG. 4 (scale ¼) shows the back of the back panel of the embodiment of the radiator of the invention.

FIG. 4 shows the back of the back panel. Position 16 refers to the "cooling ribs". Position 17 shows the openings for the bolts for attachment. Position 18 shows the points to attach the radiator to the wall. Position 19 shows the connector for the drainage pipe. Position 20 shows the connector for the water supply. Position 21 shows the connector for the de-aeration tap.

Figure 5:
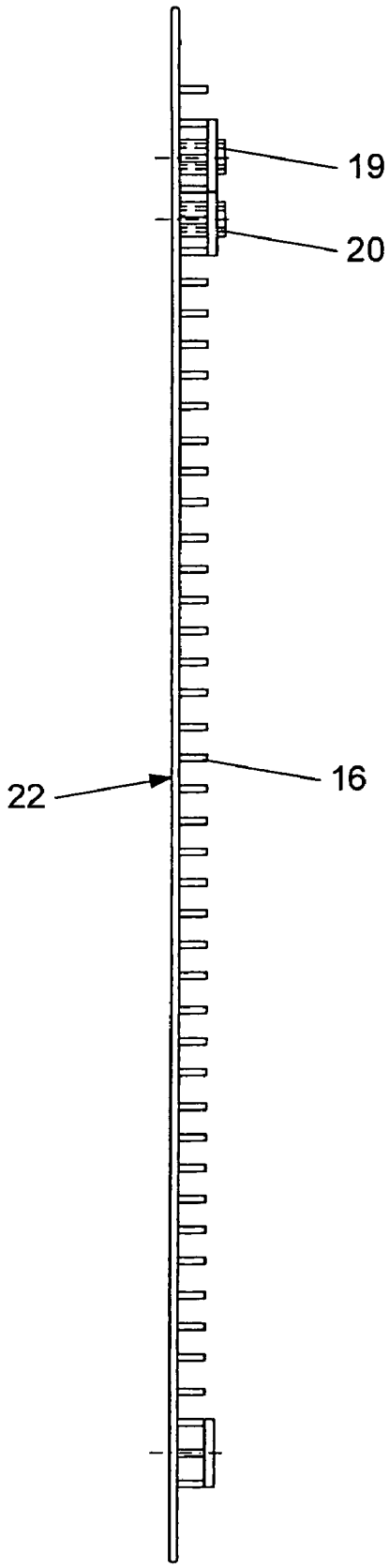
FIG. 5 (scale ¼) shows a top view of the back panel of the embodiment of the radiator of the invention.

FIG. 5 shows a top view of the back panel. Position 22 shows the flat side, that makes contact with the water and it will heat the water of the humidifier via the sides. Position 16 shows the cooling ribs, so not the position of the cavities of the humidifiers. Position 19 shows the connector of the drainage of the water. Position 20 shows the connector of the water supply.

The invention claimed is:

1. A radiator comprising a front panel and a back panel between which an interior space is provided for introducing a fluid, the front panel being made of a synthetic material, the back panel being made of a heat-conductive material, a seal being provided between the panels for making said interior space substantially fluid-tight, the front and back panels being assembled with the seal in between by assembling means, charactierised in that the back panel is provided with fluid supply and drainage fittings for supplying and draining the fluid to and from said interior space, that the back panel is provided with heat exchanging means for exchanging heat with surrounding air and mounting means for mounting the radiator on a wall, and that the front panel has pre-formed canals for detecting the fluid flow in a controlled way from the supply fitting to the drainage fitting.

2. The radiator according to claim 1, characterised in that the synthetic material of the front panel is non-heat-conductive.

3. The radiator according to claim 1, characterised in that the synthetic material of the front panel is a polyamide.

4. The radiator according to claim 1, characterised in that the front panel has a visible side which is provided with a relief pattern, the visible side being the side opposite the one with the pre-formed canals.

5. The radiator according to claim 1, characterised in that the back panel has a top side with slots for evacuating hot air from the back panel.

6. The radiator according to claim 1, characterised in that the radiator comprises an air humidifier which is formed as a hollow space on a side between the front panel and the back panel, said hollow space being provided for containing water and having an opening on top for introducing water and dispensing water vapour.

7. The radiator according to claim 6, characterised in that the opening is provided with a detachable cap which comprises holes for dispensing water vapour.

8. The radiator according to claim 1, characterised in that the front panel is constructed by means of injection moulding.

9. The radiator according to claim 1, characterised in that the back panel is made of aluminium or a composite material and has a first side directed to said interior space and a second side opposite the first side comprising the cooling ribs, the first side being substantially flat and being provided for contacting the fluid which flows through the canals and the water which is introduced into the hollow space of the humidifier.

10. The radiator according to claim 1, characterised in that the second side of the back panel is provided with mounting brackets for mounting the radiator on a wall.

11. The radiator according to claim 1, characterised in that the back panel is constructed by means of injection without post-treatment.

12. The radiator according to claim 1, characterised in that the back panel is constructed by means of extrusion with post-treatment for selectively removing cooling ribs.

13. The radiator according to claim 1, characterised in that the back panel is constructed by means of rolling with post-treatment for selectively removing cooling ribs.

14. The radiator according to claim 1, characterised in that the front panel has a visible side which is provided with a relief pattern, the visible side being the opposite the one with the pre-formed canals.

15. The radiator according to claim 1, characterised in that the preformed canals are provided for causing a warming-up effect in ascending direction.

* * * * *